US005293846A

United States Patent [19]

Takahashi

[11] Patent Number: 5,293,846

[45] Date of Patent: Mar. 15, 1994

[54] TWO-CYCLE ENGINE FOR AN OUTBOARD MOTOR

[75] Inventor: Masanori Takahashi, Shizuoka, Japan

[73] Assignee: Sanshin Kogyo Kabushiki Kaisha, Hamamatsu, Japan

[21] Appl. No.: 938,391

[22] Filed: Aug. 31, 1992

Related U.S. Application Data

[63] Continuation-in-part of Ser. No. 622,923, Dec. 6, 1990, Pat. No. 5,143,028.

[30] Foreign Application Priority Data

Dec. 11, 1989 [JP] Japan ..... 1-320977
Nov. 16, 1991 [JP] Japan ..... 3-328060

[51] Int. Cl.[5] ..... F02B 33/38; F02B 67/10
[52] U.S. Cl. ..... 123/65 BA; 123/559.1
[58] Field of Search ..... 123/59 A, 59 B, 65 BA, 123/195 P, 559.1

[56] References Cited

U.S. PATENT DOCUMENTS

| | | | |
|---|---|---|---|
| 1,720,414 | 7/1929 | Gruebler | 123/559.1 |
| 1,874,681 | 8/1932 | Woolson | 123/65 BA X |
| 2,099,852 | 11/1937 | Knudsen | 123/48 C |
| 2,221,405 | 11/1940 | Nallinger | 123/559.1 |
| 2,252,512 | 8/1941 | Keller | 123/65 BA X |
| 2,259,385 | 10/1941 | Lindenmuth | 123/65 BA |
| 2,367,565 | 1/1945 | Curtis | 123/65 VC |
| 2,645,214 | 7/1953 | Birnstiel | 123/74 AE |
| 2,744,506 | 5/1956 | Reynolds | 123/301 |
| 2,787,987 | 4/1957 | Portmann | 123/65 R |
| 2,820,339 | 1/1958 | Grieshaber et al. | 60/603 |
| 2,858,666 | 11/1958 | Fullemann | 123/65 BA |
| 2,887,993 | 5/1959 | Shallenberg | 123/301 |
| 2,891,524 | 6/1959 | Scheiterlein | 123/65 BA |
| 3,077,189 | 2/1963 | Earnshaw et al. | 123/65 BA |
| 4,254,752 | 3/1981 | Friddell et al. | 123/323 |

FOREIGN PATENT DOCUMENTS

| | | | |
|---|---|---|---|
| 842238 | 6/1952 | Fed. Rep. of Germany . | |
| 517020 | 4/1921 | France | 123/559.1 |
| 949749 | 2/1949 | France | 123/65 BA |
| 2-76126 | 6/1990 | Japan . | |
| 294520 | 12/1990 | Japan | 123/559.1 |
| 151654 | 2/1922 | United Kingdom | 123/559.1 |

*Primary Examiner*—Tony M. Argenbright
*Attorney, Agent, or Firm*—Knobbe, Martens, Olsen & Bear

[57] ABSTRACT

An outboard motor including a supercharged internal combustion engine. The supercharger is positioned on a side of the crankcase opposite from the cylinders of the engine and is driven by the crankshaft through any of a plurality of different forms of drive arrangements that permit axially adjustment to maintain alignment.

32 Claims, 6 Drawing Sheets

TWO-CYCLE ENGINE FOR AN OUTBOARD MOTOR

CROSS REFERENCE TO RELATED APPLICATION

This application is a continuation-in-part of my application entitled "Supercharged V-Type Two Cycle Engine", Ser. No. 622,923, filed Dec. 6, 1990 and issued as U.S. Pat. No. 5,143,028 on Sep. 1, 1992, which application is assigned to the Assignee hereof.

BACKGROUND OF THE INVENTION

This invention relates to a two-cycle engine for an outboard motor and more particularly to an improved supercharger and drive arrangement for an internal combustion engine.

The use of superchargers to improve the performance of internal combustion engines is well known. Superchargers have particular utility with two-cycle internal combustion engines because they can not only improve the performance of the engine but also improve the scavenging of the engine. Superchargers have particular utility in outboard motors because of the power increase which they can obtain and this has considerable advantage in permitting a compact, high power outboard motor. However, because of the compactness required for outboard motors, the placement and drive arrangement for a supercharger can be particularly critical, particularly with this type of application.

The supercharger should be basically positioned relatively close to the crankshaft of the engine, from which it is driven In some types of applications, this is accomplished by placing the supercharger is a generally aligned relationship with the crankshaft so that it can be driven nearly directly off end the crankshaft and the supercharger extends beyond the front of the engine. However, when mounted in an outboard motor, this gives rise to considerable height of the engine and at the power head and this is not at all desirable.

It is, therefore, a principal object of this invention to provide an improved supercharger and drive arrangement for an internal combustion engine and particularly one which may be utilized in conjunction with an outboard motor.

It is a further object to this invention to provide an improved and compact supercharger, internal combustion engine arrangement.

In outboard motor applications, it is desirable to maintain a low center of gravity of the outboard motor. In addition, the outboard motor is frequently tilted up about a horizontally disposed axis and it is desirable to maintain the center of gravity as far forward as possible so as to assist in this tilting up operation.

It is, therefore, a still further object to this invention to provide an improved supercharger drive arrangement for an outboard motor wherein the supercharger can be positioned at the front of the outboard motor and will not extend vertically above the engine.

SUMMARY OF THE INVENTION

This invention is adapted to be embodied in an internal combustion engine comprising a crankcase that rotatably journals a crankshaft, a cylinder extends from the crankcase on one side of a plane containing the axis of rotation of the crankshaft. A supercharger for delivering a pressurized air charge to an induction system of the engine is positioned on the other side of the plane and means are providing for driving the supercharger from the crankshaft.

DETAILED DESCRIPTION OF THE PREFERRED EMBODIMENTS OF THE INVENTION

Figure 1:
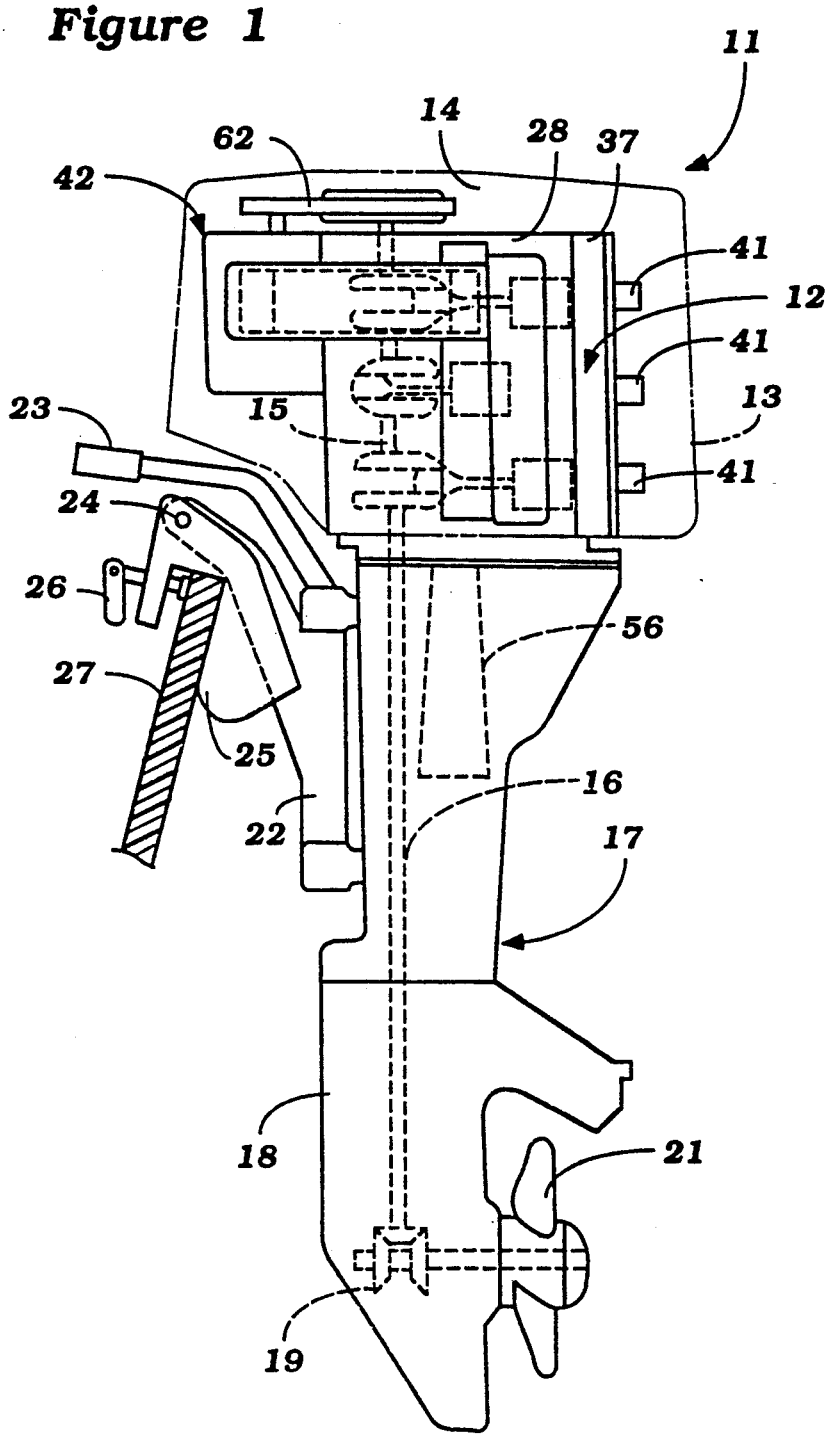
FIG. 1 is a side elevational view of an outboard motor constructed in accordance with an embodiment of the invention, with a portion shown in phantom.
Figure 2:
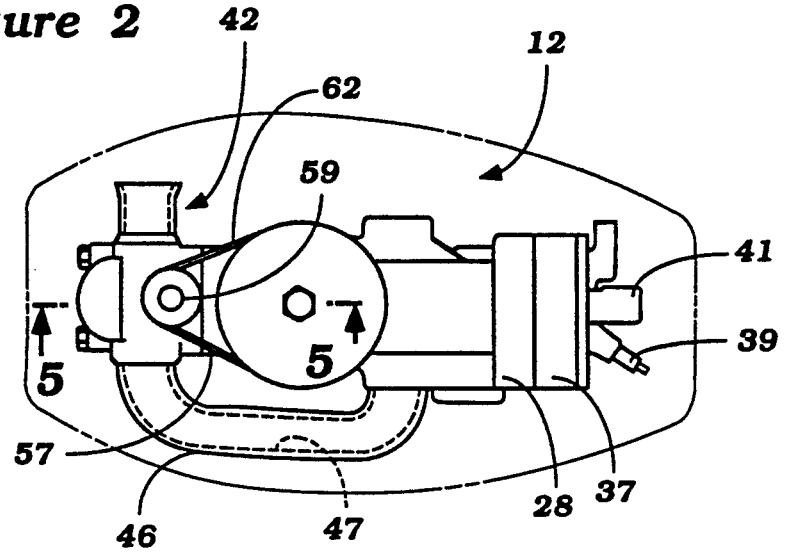
FIG. 2 is a top plan view of the outboard motor, with the same portion being shown in phantom.
Figure 3:
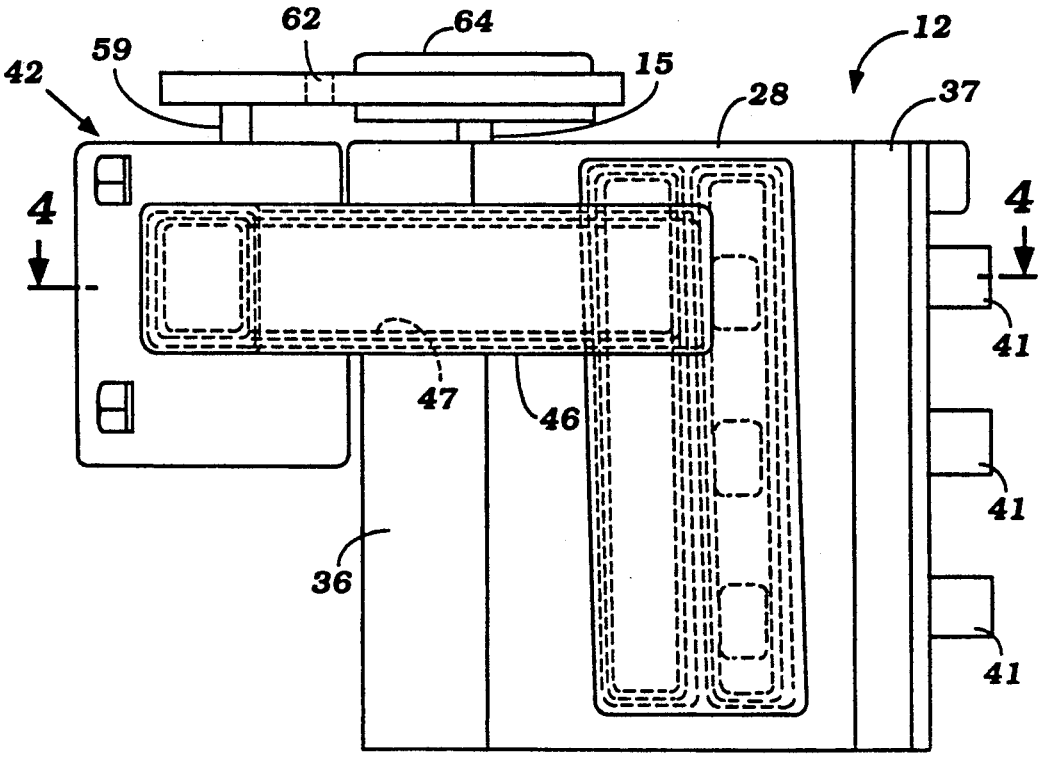
FIG. 3 is a enlarged side elevational view of the internal combustion engine of the outboard motor.
Figure 4:
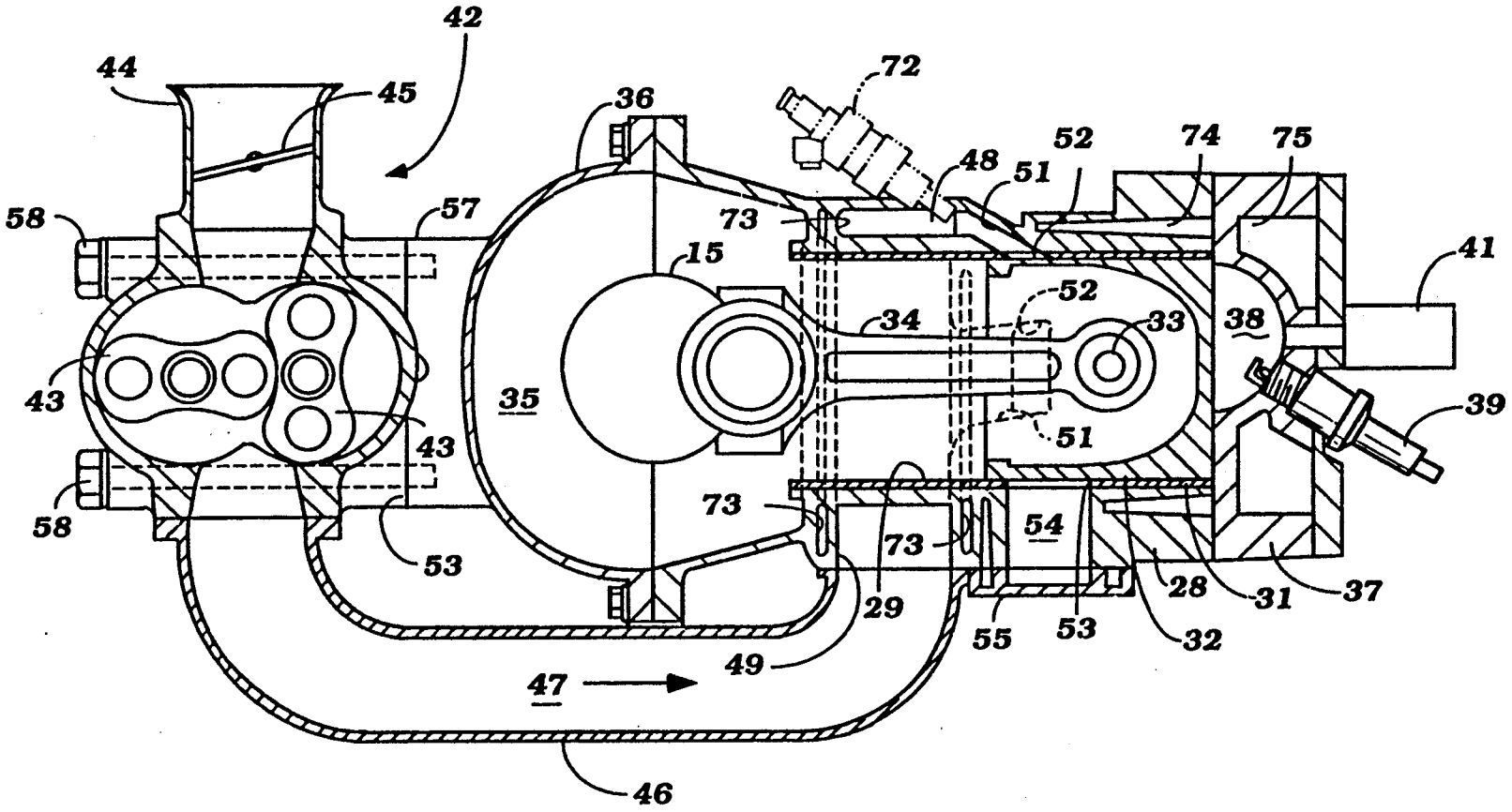
FIG. 4 is a further enlarged cross sectional view taken along the line 4—4 of FIG. 3.

Referring first to the embodiment of FIGS. 1 through 5 and initially to FIG. 1, an outboard motor constructed in accordance with an embodiment of the invention is identified generally by the reference numeral 11. The invention is described in conjunction with an outboard motor because it has particular utility with such applications due to their specific requirements for compactness and low center of gravity. Also, the invention has particular utility with two-cycle engines and such engines are normally employed as the power units in outboard motors. It is to be understood, however, that the invention can be employed with a wide variety of other types of applications for internal combustion engines and other types of engines than those specifically disclosed.

The outboard motor 11 is comprised of a power head consisting of an internal combustion engine, indicated generally by the reference numeral 12 and a surrounding protective cowling, shown in phantom and identified at 13. The protective cowling 13 defines an internal cavity 14 in which the engine 12 is positioned.

As is typical with outboard motor practice, the engine 12 is disposed so that its crankshaft 15 rotates about a vertically extending axis. The crankshaft 15 drives a drive shaft 16 which depends into a drive shaft housing 17 positioned beneath the power head. The drive shaft 16 further extends into a lower unit 18 where it drives a forward, neutral, reverse transmission 19 of a known type for driving a propeller 21 in selected forward and reverse directions.

A steering shaft (not shown) is affixed to the drive shaft housing 17 and is journalled within a swivel bracket 22 for steering movement about a generally vertically extending axis for steering of the outboard motor 11. A tiller 23 is affixed to he upper end of this steering shaft for accomplishing the steering action.

The swivel bracket 22 is pivotally connected by means of a pivot pin 24 to a clamping bracket 25 for tilt and trim movement of the outboard motor 11 about a horizontally extending axis defined by the pivot pin 24. A clamping assembly 26 is carried by the clamping bracket 25 for detachably affixing the outboard motor 11 to a transom 27 of an associated watercraft. The aforenoted construction is typical with outboard motor practice and for that reason, further details of the construction of the outboard motor are not necessary to understand the construction and operation of the invention.

Referring now in detail to the remaining figures of this embodiment in addition to Figure the engine 12 in the illustrated embodiment is of the three cylinder in-line type although, as has been noted, the invention can be employed with engines of other configuration. To this end, the engine 12 is comprised of a cylinder block 28 that is formed with three aligned cylinder bores 29, each by a respective pressed or cast-in cylinder liner 31. A piston 32 is reciprocally supported within each cylinder bore 29 and is connected by means of a piston pin 33 to a connecting rod 34. The opposite or big end of the connecting rod 34 is journalled on a throw of the crankshaft 15, which is, in turn, rotatably journalled in a known manner within a crankcase chamber 35 formed by the skirt portion of the cylinder block 28 and a crankcase member 36 that is affixed to this skirt portion in any known manner.

A cylinder head assembly 37 is affixed to the cylinder block 28 in a known manner and is provided with a plurality of individual recesses 38 which cooperate with the cylinder bores 29 and heads of the pistons 32 to form the combustion chambers. Spark plugs 39 are carried by the cylinder head assembly 37 and have their gaps protruding into the cylinder head recesses 38 for firing a charge in a known manner. Fuel injectors 41 are also supported in the cylinder head assembly 37 and discharge into the recesses 38 for supplying a fuel charge thereto. If desired, the injectors 41 may be fuel/air injectors as opposed to pure fuel injectors.

An air charge is supplied to the combustion chamber by an induction system that includes a scavenge pump or supercharger, indicating generally by the reference numeral 42. In the illustrated embodiment, the supercharger 42 is of the positive displacement, Roots type having a pair of intermeshing rotors 43 which are driven in a manner to be described and which draw air through an air inlet 44 in which a manually operated throttle valve 45 is provided for controlling engine speed. This charge is then compressed by the operation of the rotors 43 and is discharged into a manifold 46 that is disposed at one side of the engine 12 and which has a manifold passageway 47.

This manifold passageway 47 communicates with a plenum chamber 48 that is formed in the cylinder block 28 around the lower portion of each of the cylinder liners 31. A single air inlet opening 49 extends through the cylinder block 28 and communicates with the passageway 47 for delivering this air charge under pressure to the plenum chamber 48.

A plurality of scavenge passages 51, three in the illustrated embodiment, extend from the plenum chamber 48 and terminate in respective scavenge ports 52 formed at circumferentially spaced locations around each of the cylinder liners 31 so as to admit a pressurized charge to the combustion chamber when the piston 32 uncovers the scavenge ports 52. The scavenge ports 52 and scavenge passages 51 are configured so as to provide a Schnurle type of scavenging for the engine.

The charge is fired by the spark plug 39 and drives the pistons 32 downwardly. The burnt charge is exhausted through an exhaust port 53 formed in each cylinder liner 31 and disposed between two of the scavenge ports 52. The exhaust port 53 communicates with an exhaust manifold 54 formed in the cylinder block 28 and closed by a cover plate 55. This exhaust manifold 54 then discharges the exhaust gases downwardly into the drive shaft housing 17 through an exhaust pipe 56 (FIG. 1).

The interior of the drive shaft housing 17 acts as an expansion chamber and the exhaust gases are discharged to the atmosphere from this expansion chamber. This exhaust gas discharge may comprise a conventional through-the-hub propeller, high speed exhaust gas discharge and a small restricted above-the-water, low speed exhaust gas discharge. When operating at high speeds and when the propeller 21 is relatively shallowly submerged, the exhaust gases will primarily pass out of this exhaust. However, as the outboard motor 11 operates at a low speed and the propeller 21 becomes more submerged, the exhaust gases may discharge through the above-the-water exhaust gas discharge. This type of exhaust system is well known in this art and, therefore, further discussion of it is not believed to be necessary.

It should be noted that the cylinder block 28 and specifically the cylinder liners 31 extend from one side of a plane containing the axis of rotation of the crankshaft 15 while the supercharger 42 lies on the other side of this plane. As clearly seen in FIG. 1, this places the rather heavy supercharger 42 at a low location, since it does not extend axially beyond the cylinder block 28 and crankcase 36 and also places it in a forwardmost location so that the weight of the supercharger 42 will assist in the tilt and trim operation rather than resist it. This also places the supercharger 42 in a location relatively free of the remaining volume 14 defined by the protective cowling 13 and does not increase the height in any way of the overall assembly.

The supercharger 42 is mounted on a boss 57 which can be integrally formed with the crankcase 36 but which extends in a direction opposite to the cylinder liners 31. Mounting bolts 58 are provided for this purpose.

The rotors 43 are driven by a supercharger drive shaft 59 which extends upwardly beyond the upper face of the engine 12 and specifically the cylinder block 28 and crankcase 36. As may be best seen in FIG. 5, a pulley 61 is affixed to the supercharger drive shaft 59 by means of an assembly that permits its axial adjustment. A drive belt 62 is trained around this pulley 62 and a further pulley 63 formed integrally with a flywheel 64 that is affixed to the crankshaft 15 by a retaining nut 65 and key (not shown). The driving pulley 63 may be also formed with a gear 66 for cooperation with a starter (not shown) for electrical starting of the engine 12.

Figure 5:
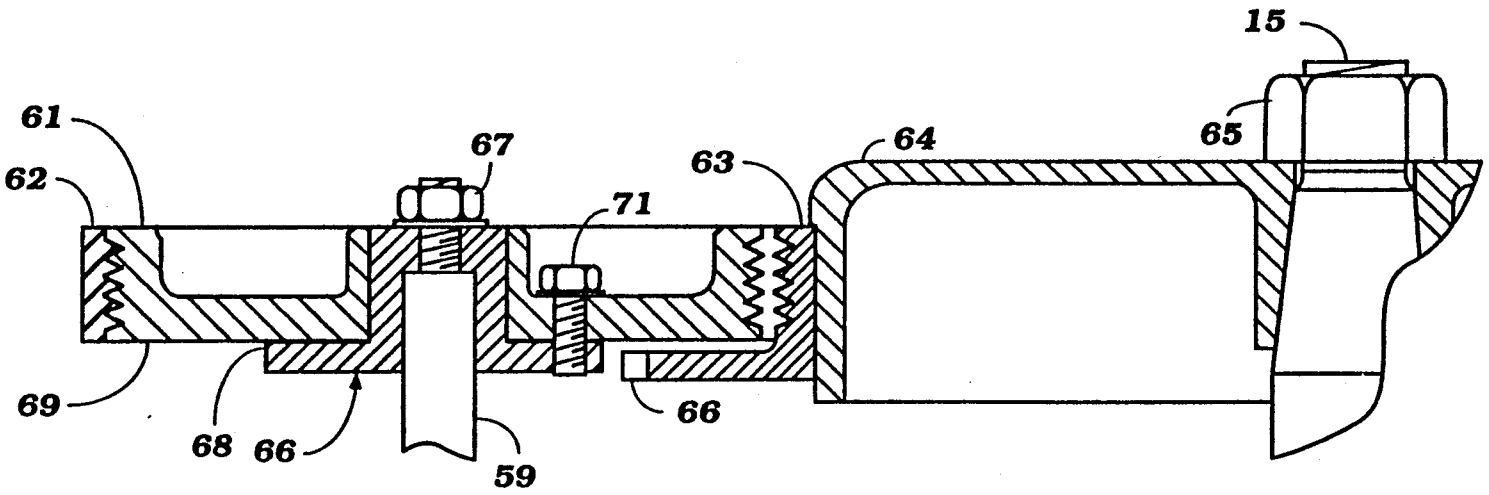
FIG. 5 is an enlarged cross sectional view taken along the line 5—5 of FIG. 4 showing the manner of adjustment of the axial position of the supercharger drive in this embodiment.

In order to assure axial alignment between the driving pulley 63 and the driven pulley 61, the connection shown in FIG. 5 is provided. This connection includes a generally cup-shaped member 66 that is affixed to the end of the supercharger drive shaft 59 by a threaded fastener 67. Shims 68 are interposed between the flange of the cup-shaped member 66 and a facing surface 69 of the driven pulley 61 so as to adjust the height of the driven pulley 61 and maintain its axial alignment with the driving pulley 63. Threaded fasteners 71 affix the driven pulley 61 to the cup-shaped member 66.

In the injection system for the engine 12 as thus far described, there has been provided a fuel injector 41 that supplies fuel directly into the combustion chamber.

If desired, an auxiliary or supplemental fuel injector 72 (shown in phantom in FIG. 4) may be provided for injecting fuel into one of the scavenge passages 51 associated with each cylinder to provide supplemental fuel to accommodate certain running conditions. In addition, a cooling jacket 73 is formed in the cylinder block 28 above and below the plenum chamber 48 to provide cooling for the intake charge. The cooling jacket 73 is supplied with coolant from the engine cooling system which also includes a cylinder block cooling jacket 74 and a cylinder head cooling jacket 75.

Figure 6:
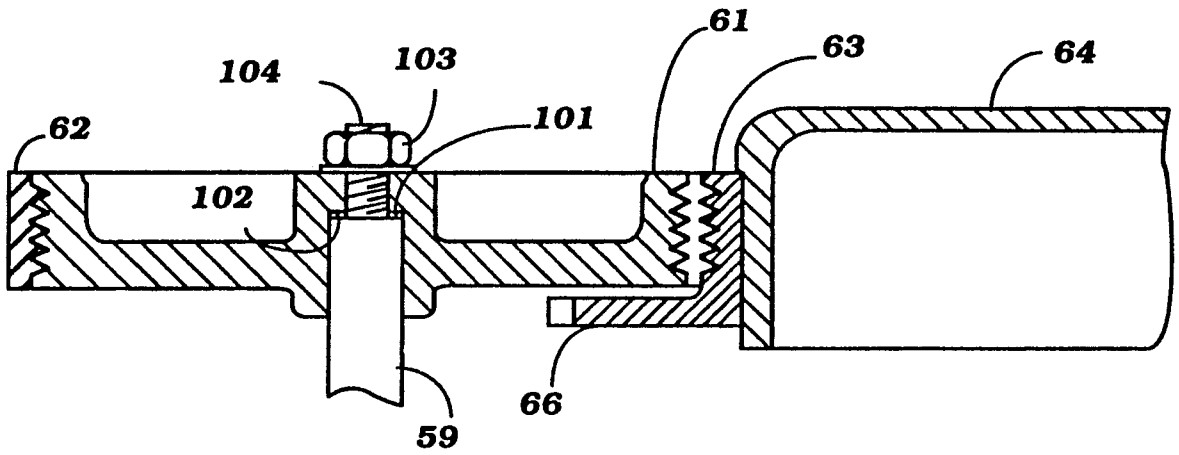
FIG. 6 is a cross sectional view, in part similar to FIG. 5, showing another way in which the axial position of the supercharger drive can be adjusted.

FIG. 6 shows another embodiment of the invention which differs from the previously described embodiment only in the manner in which the axial alignment between the driving pulley 63 of the flywheel 64 and the driven pulley 61 associated with the supercharger drive shaft 59 may be adjusted. In this embodiment, an adjusting shim 101 is positioned between the end of the supercharger drive shaft 59 and a facing shoulder 102 formed by a counter bore in the driven pulley 61. A retaining nut 103 is fasten onto a stud 104 which is either threaded into the supercharger drive shaft 59 or formed integrally with it.

Figure 7:
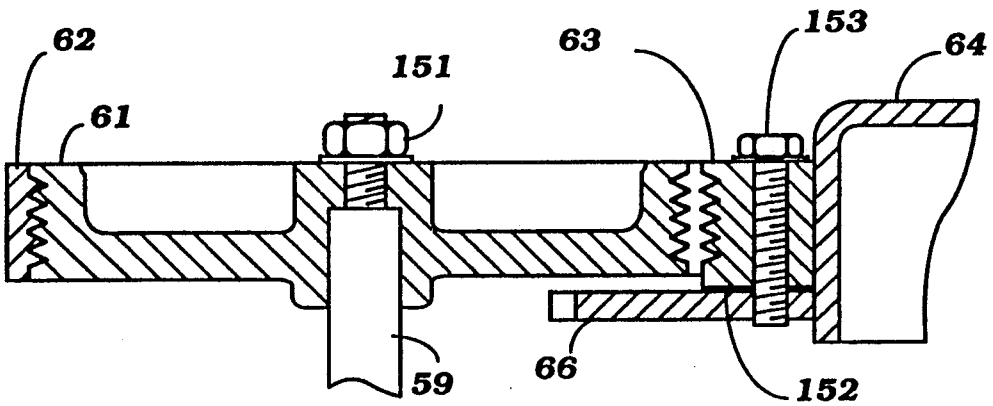
FIG. 7 is a cross sectional view, in part similar to FIGS. 5 and 6, showing a further way in which the supercharger drive may be adjusted.

In the embodiments of FIGS. 5 and 6, it is the supercharger driven pulley 61 which has been adjusted to maintain alignment with the driving flywheel pulley 63. FIG. 7 shown an embodiment wherein the driving pulley is axially adjusted rather than the driven pulley. In this embodiment, the supercharger driven pulley 61 is affixed axially to the supercharger drive shaft 59 by a threaded fastener 151 much like the fastener assembly of the embodiment of FIG. 6. The driving pulley 63 rather than being formed integrally with a starter gear 66 is, in this embodiment, a separate piece and adjusting shims 152 are provided between the starter gear 66 and the driving pulley 63 for axial adjustment. Threaded fasteners 153 affix the shim 152, starter 66 and driving pulley 63 to each other and to the flywheel 64.

It should be readily apparent from the foregoing description that the described embodiments of the invention provide an extremely compact supercharger drive arrangement for an engine and one in which the supercharger may be positioned to permit a compact assembly close to the driving crankshaft. Also, various adjustments have been disclosed. However, these embodiments are preferred embodiments of the invention and various changes and modifications may be made without departing from the spirit and scope of the invention, as defined by the appended claims.

I claim:

1. An internal combustion engine of the two cycle type comprising a crankcase rotatably journalling a crankshaft, a cylinder extending from said crankcase on one side of a plane containing the axis of rotation of said crankshaft and perpendicular to said cylinder, a supercharger for delivering a pressurized air charge to a scavenge system of said engine, said supercharger being positioned on the other side of said plane, and means for driving said supercharger from said crankshaft.

2. An internal combustion engine as set forth in claim 1 wherein the supercharger delivers the charge to the scavenge system through a manifold disposed on one side of the engine.

3. An internal combustion engine as set forth in claim 2 wherein the manifold delivers the pressurized charge to a plenum chamber formed around a cylinder of the engine.

4. An internal combustion engine comprising a crankcase rotatably journalling a crankshaft, a cylinder extending from said crankcase on one side of a plane containing the axis of rotation of said crankshaft and perpendicular to said cylinder, a supercharger for delivering a pressurized air charge to an induction system of said engine, said supercharger being positioned on the other side of said plane, and means for driving said supercharger from said crankshaft, said supercharger being disposed so that it does not extend beyond an end of said crankcase.

5. An internal combustion engine as set forth in claim 4 wherein the engine comprises a two-cycle, internal combustion engine and the supercharger delivers the charge to a scavenge system for the engine.

6. An internal combustion engine as set forth in claim 5 wherein the supercharger delivers the charge to the scavenge system through a manifold disposed on one side of the engine.

7. An internal combustion engine as set forth in claim 6 wherein the manifold delivers the pressurized charge to a plenum chamber formed around a cylinder of the engine.

8. An internal combustion engine as set forth in claim 4 wherein the crankshaft is rotatably about a vertically extending axis.

9. An internal combustion engine as set forth in claim 8 wherein the engine forms the power engine of a power head of an outboard motor and is contained within a protective cowling of the power head.

10. An internal combustion engine as set forth in claim 9 wherein the engine comprises a two-cycle, internal combustion engine and the supercharger delivers the charge to a scavenge system for the engine.

11. An internal combustion engine as set forth in claim 10 wherein the supercharger delivers the charge to the scavenge system through a manifold disposed on one side of the engine.

12. An internal combustion engine as set forth in claim 11 wherein the manifold delivers the pressurized charge to a plenum chamber formed around a cylinder of the engine.

13. An internal combustion engine as set forth in claim 4 further including means for adjusting the axial positioning of the means for driving the supercharger from the crankshaft to maintain axial alignment between a driving member affixed to the crankshaft and a driven member affixed for rotation with a drive shaft of the supercharger which driving shaft rotates about an axis parallel to the axis of the crankshaft.

14. An internal combustion engine as set forth in claim 13 wherein the driven member is axially adjustable relative to the supercharger drive shaft.

15. An internal combustion engine as set forth in claim 13 wherein the driving member is axially adjustable with respect to the crankshaft.

16. An internal combustion engine as set forth in claim 13 wherein the driving members and the driven members comprise driving and driven pulleys and further including a belt for driving the driven pulley from the driving pulley.

17. An internal combustion engine as set forth in claim 16 wherein the driven pulley is axially adjustable relative to the supercharger drive shaft.

18. An internal combustion engine as set forth in claim 16 wherein the driving pulley is axially adjustable with respect to the crankshaft.

19. An internal combustion engine comprising a crankcase rotatably journalling a crankshaft about a vertically extending axis, a cylinder extending from said crankcase on one side of a plane containing the axis of rotation of said crankshaft, a supercharger for delivering a pressurized air charge to an induction system of said engine, said supercharger being positioned on the other side of said plane and not beyond an end of said crankcase, and means for driving said supercharger from said crankshaft.

20. An internal combustion engine as set forth in claim 19 wherein the engine comprises a two-cycle, internal combustion engine and the supercharger delivers the charge to a scavenge system for the engine.

21. An internal combustion engine as set forth in claim 20 wherein the supercharger delivers the charge to the scavenge system through a manifold disposed on one side of the engine.

22. An internal combustion engine as set forth in claim 21 wherein the manifold delivers the pressurized charge to a plenum chamber formed around a cylinder of the engine.

23. An internal combustion engine as set forth in claim 19 wherein the engine forms the power engine of a power head of an outboard motor and is contained within a protective cowling of the power head.

24. An internal combustion engine as set forth in claim 23 wherein the engine comprises a two-cycle, internal combustion engine and the supercharger delivers the charge to a scavenge system for the engine.

25. An internal combustion engine as set forth in claim 24 wherein the supercharger delivers the charge to the scavenge system through a manifold disposed on one side of the engine.

26. An internal combustion engine as set forth in claim 25 wherein the manifold delivers the pressurized charge to a plenum chamber formed around a cylinder of the engine.

27. An internal combustion engine comprising a crankcase rotatably journalling a crankshaft, a cylinder extending from said crankcase on one side of a plane containing the axis of rotation of said crankshaft, a supercharger for delivering a pressurized air charge to an induction system of said engine, said supercharger being positioned on the other side of said plane and disposed so that said supercharger does not extend beyond an end of said crankcase, means for driving said supercharger from said crankshaft, and means for adjusting the axial positioning of said means for driving said supercharger from said crankshaft to maintain axial alignment between a driving member affixed to said crankshaft and a driven member affixed for rotation with a drive shaft of the supercharger which driving shaft rotates about an axis parallel to the axis of said crankshaft.

28. An internal combustion engine as set forth in claim 27 wherein the driven member is axially adjustable relative to the supercharger drive shaft.

29. An internal combustion engine as set forth in claim 27 wherein the driving member is axially adjustable with respect to the crankshaft.

30. An internal combustion engine as set forth in claim 27 wherein the driving members and the driven members comprise driving and driven pulleys and further including a belt for driving the driven pulley from the driving pulley.

31. An internal combustion engine as set forth in claim 30 wherein the driven pulley is axially adjustable relative to the supercharger drive shaft.

32. An internal combustion engine as set forth in claim 31 wherein the driving pulley is axially adjustable with respect to the crankshaft.

* * * * *